US005667409A

United States Patent [19]

Wong et al.

[11] Patent Number: 5,667,409

[45] Date of Patent: Sep. 16, 1997

[54] STRUCTURE IMPROVEMENT FOR THE CONNECTOR OF COAXIAL CABLE

[76] Inventors: Shen-Chia Wong; Cheng Sun Lan, both of No. 10, Lane 121, Li-Der Rd., Peito District, Taipei, Taiwan

[21] Appl. No.: 579,214

[22] Filed: Dec. 28, 1995

[51] Int. Cl.[6] ..... H01R 25/00

[52] U.S. Cl. ..... 439/654; 439/578; 439/675; 439/852

[58] Field of Search ..... 439/578, 575, 439/675, 651, 654, 655, 852

[56] References Cited

U.S. PATENT DOCUMENTS

| | | | |
|---|---|---|---|
| 3,748,634 | 7/1973 | Barnes et al. | 439/852 |
| 4,068,917 | 1/1978 | Seidler | 439/852 |
| 4,326,769 | 4/1982 | Dorsey et al. | 439/578 |
| 4,681,390 | 7/1987 | Hayward | 439/578 |
| 5,021,010 | 6/1991 | Wright | 439/578 |
| 5,096,444 | 3/1992 | Lu et al. | 439/578 |
| 5,383,800 | 1/1995 | Saka et al. | 439/852 |

*Primary Examiner*—David L. Pirlot
*Attorney, Agent, or Firm*—Pro-Techtor International

[57] ABSTRACT

An improved structure for the connector of a coaxial cable ensures that there are multiple contact points between the contact component and the central wire of the coaxial cable. The connector has holes on the top and bottom of the two ends of the contact component. The material of the holes is punched inward but is not removed from the tube forming the contact component such that a pair of inclined planes extend toward the interior of each end of the tube. One pair of insulation components which slip on the inside of the connector body join with one end of the contact component to fix and to support the contact component in order to increase the quality of transmission. The connector can be used in a specific range of central wire for cable that allows larger current flows, therefore being suitable for use in a combination of TV and telephone as well as with the current cable TV system.

4 Claims, 12 Drawing Sheets

STRUCTURE IMPROVEMENT FOR THE CONNECTOR OF COAXIAL CABLE

BACKGROUND OF THE INVENTION

1. Field of the Invention

The present invention relates to an improved structure for a connector of a coaxial cable which is constructed using a stick-like contact component and an insulation component in order to reduce the power loss and to adapt to different diameter conduits (diameter from 0.5 mm to 1.2 mm) of coaxial cable.

2. Description of the Prior Art

In cable television systems, such as standard cable systems, closed-circuit TV, and a central antenna TV system, a coaxial cable is required to transmit signals. Consumers desire higher quality TV reception and the quality of the coaxial cable connector affects the quality of TV reception directly. As shown in FIG. 1, the inner structure of a conventional coaxial cable connector 60 has a flat contact spring 61. When the central wire of the cable is inserted into the connector, the structure only has two points (top and bottom) of contact jaw leading to inefficient contact and power loss. The standard connector also cannot be used in high frequency receiving. When combining both cable TV and telephone, the central wire needs to bear a larger current b cause the cable receives input signals for TV (such as TV program selection and TV shopping item selection) and provides the current for the phone.

Some manufacturers try to solve the above defects using the formula $Zo=(138/\sqrt{\epsilon})\log 10(D/d)$ to design the structure of a round pin for the connector; wherein Zo = impedance match, $\epsilon$ = material dielectric constant, D = large diameter, d = small diameter. It can be inferred from the formula that a circle will provide the best impedance match.

In a television cable system, the main line and branch line use different coaxial cable; thus, the inventor of the present invention seeks to solve the problem of power loss in a conventional connector, to solve the problem of impedance matching at high frequency, and to provide a connector that is applicable to all cables. Also, the present invention provides better contacting, allowing larger current to pass that will not create sparks during transmission, and will therefore not affect the communication quality of telephone.

SUMMARY OF THE INVENTION

A main purpose of the present invention is to provide an improved structure for the connector of a coaxial cable which ensures that there are multiple contact points between the contact component and the central wire of the coaxial cable. The connector has holes on the top and bottom of the two ends of the contact component. The material of the holes is punched inward but is not removed from the tube forming the contact component such that a pair of inclined planes extend toward the interior of each end of the tube. One pair of insulation components which slip on the inside of the connector body join with one end of the contact component to fix and to support the contact component in order to increase the quality of transmission.

A secondary purpose of the present invention is to provide the above structure which can be used in a specific range of central wire for cable that allows larger current flows, and also has better contact conduction, therefore being suitable for use in a combination of TV and telephone as well as with the current cable TV system.

BRIEF DESCRIPTION OF THE DRAWINGS

The drawings disclose an illustrative embodiment of the present invention which serves to exemplify the various advantages and objects thereof, and are as follows.

DETAILED DESCRIPTION OF THE PREFERRED EMBODIMENT

Figure 1:
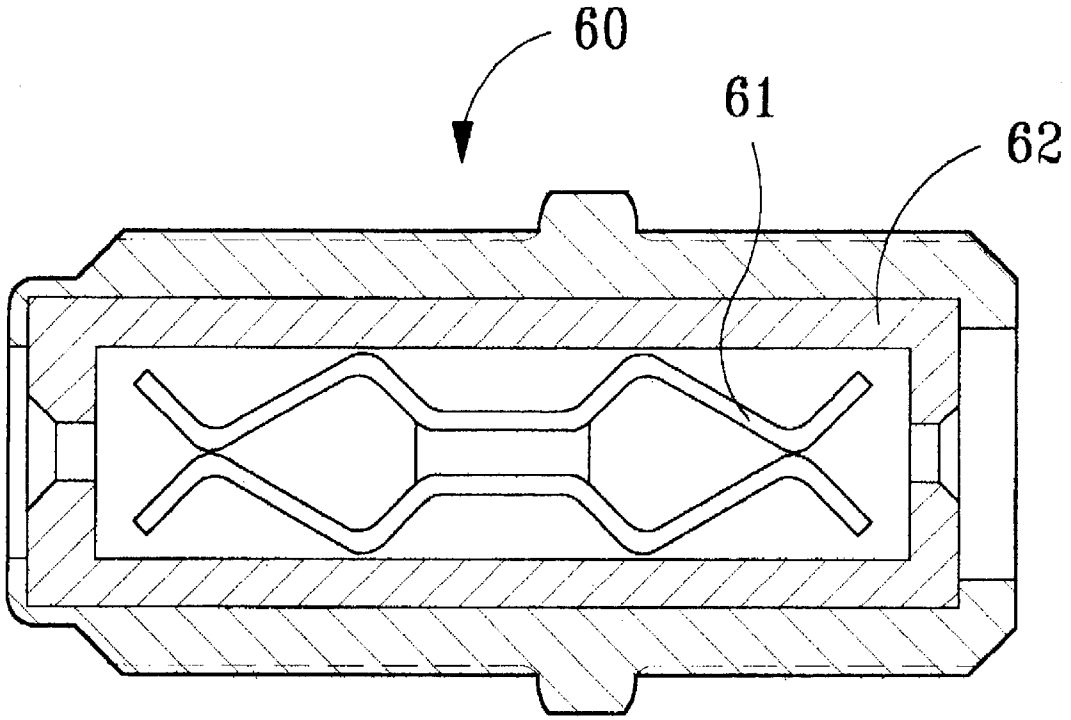
PRIOR ART FIG. 1
FIG. 1 is a cross section of a conventional connector.
Figure 2:
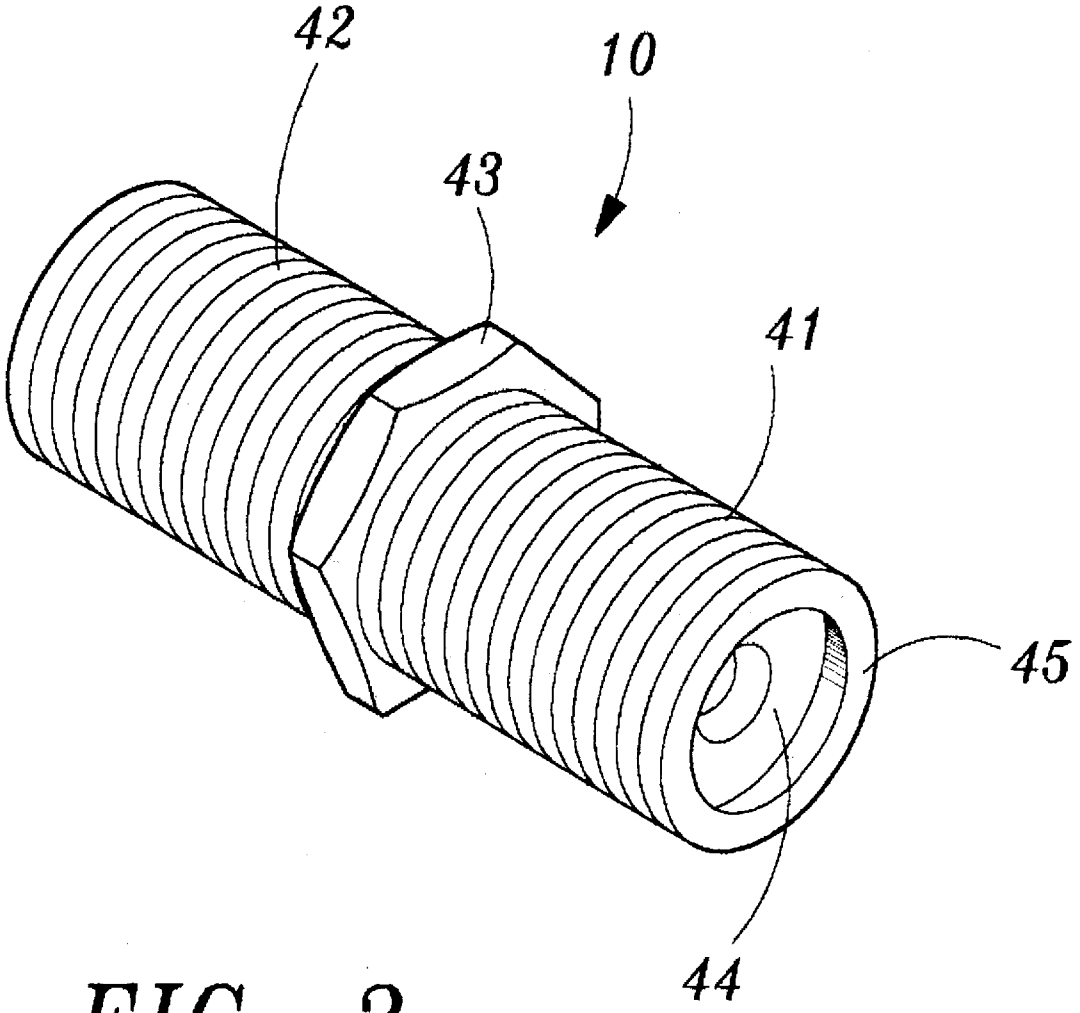
FIG. 2 is a perspective view of the first example of the present invention.
Figure 3:
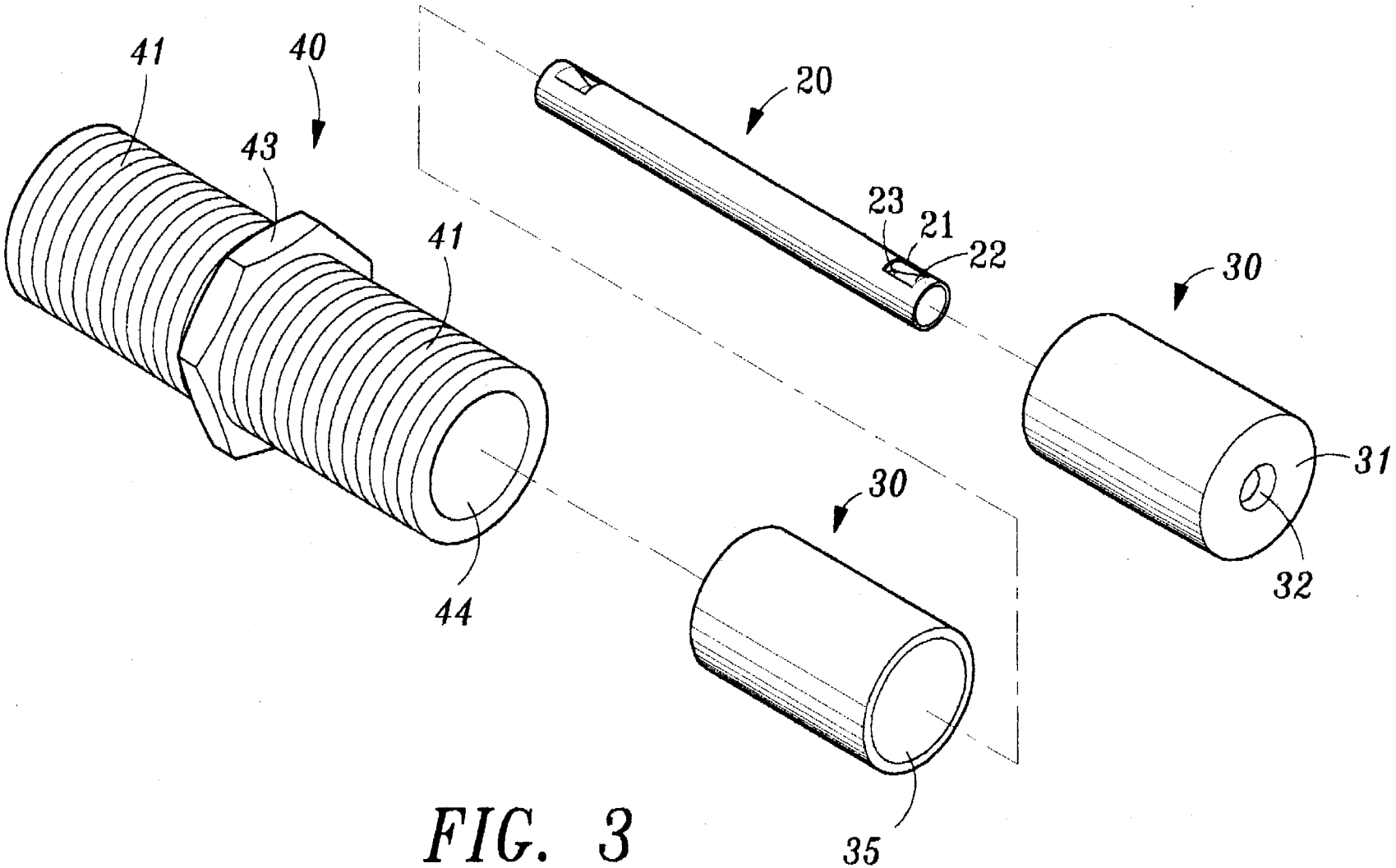
FIG. 3 is a perspective exploded view of the first example of the present invention.
Figure 4:
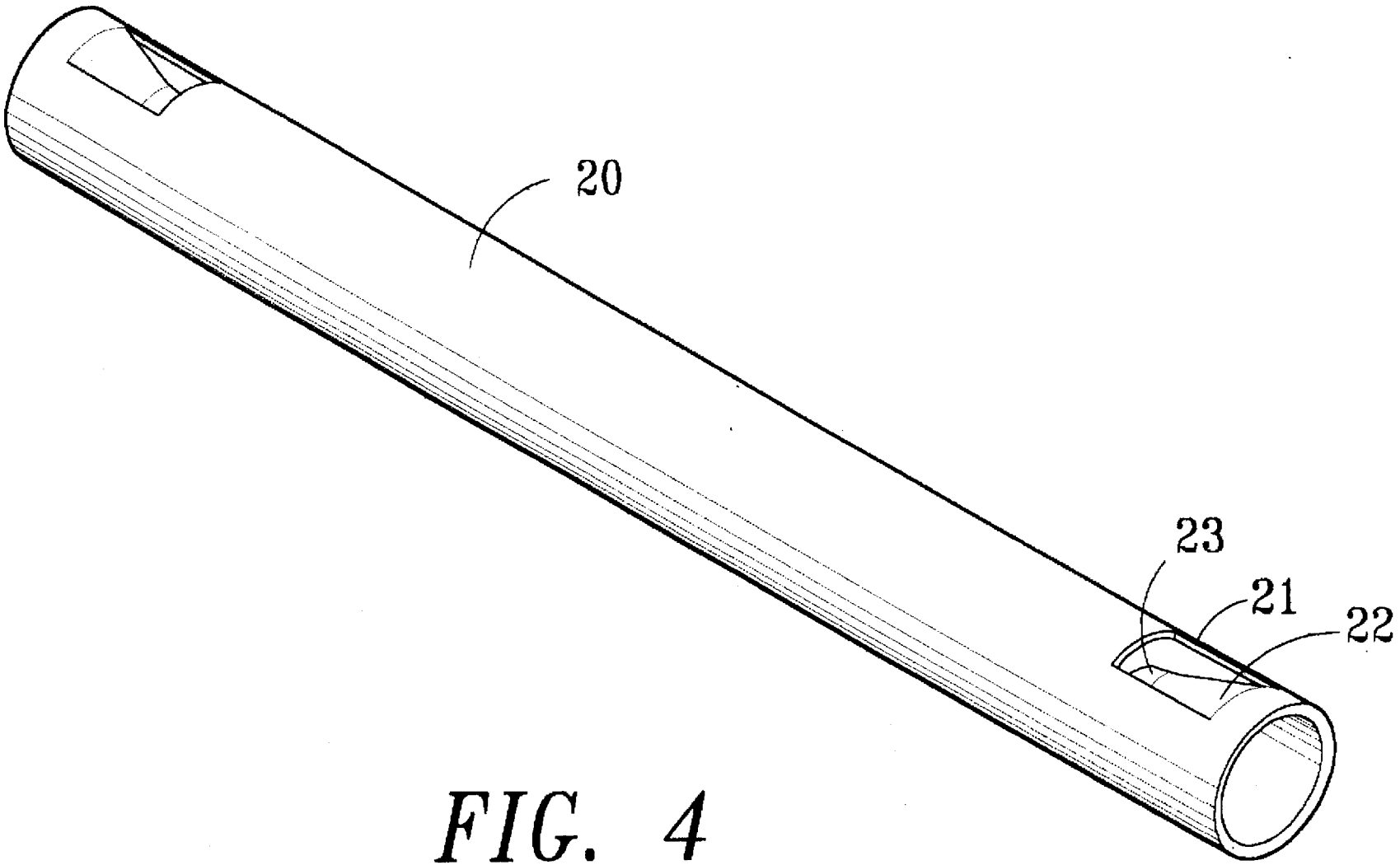
FIG. 4 is a perspective view of the contact component of the first example of the present invention.

As shown in FIG. 2, the first example of the improved connector of a coaxial cable is a female connector on two ends. Also referring to FIG. 3 to FIG. 6, the structure of the present invention includes a body 40 of the connector which includes on the outer surface thereof a hex nut 43. On either side of the hex nut 43 are threaded areas 41 and 42. Inside the connector body 40 is a channel 44 which covered by a pair of insulation components 30. These two insulation components 30 contact the inner surface 35 of the body 40. The interior of each outer end 31 of the insulation components 30 includes a socket 33 that receives a tube-like contact component 20 (see FIG. 4 and FIG. 4A). Each outer end 31 of the insulation component 30 includes a hole 32 (see FIG. 5). The diameter hole 32 is smaller than the inner diameter of contact component 20 so that the contact component 20 is held in place in the insulation component 30.

Figure 7:
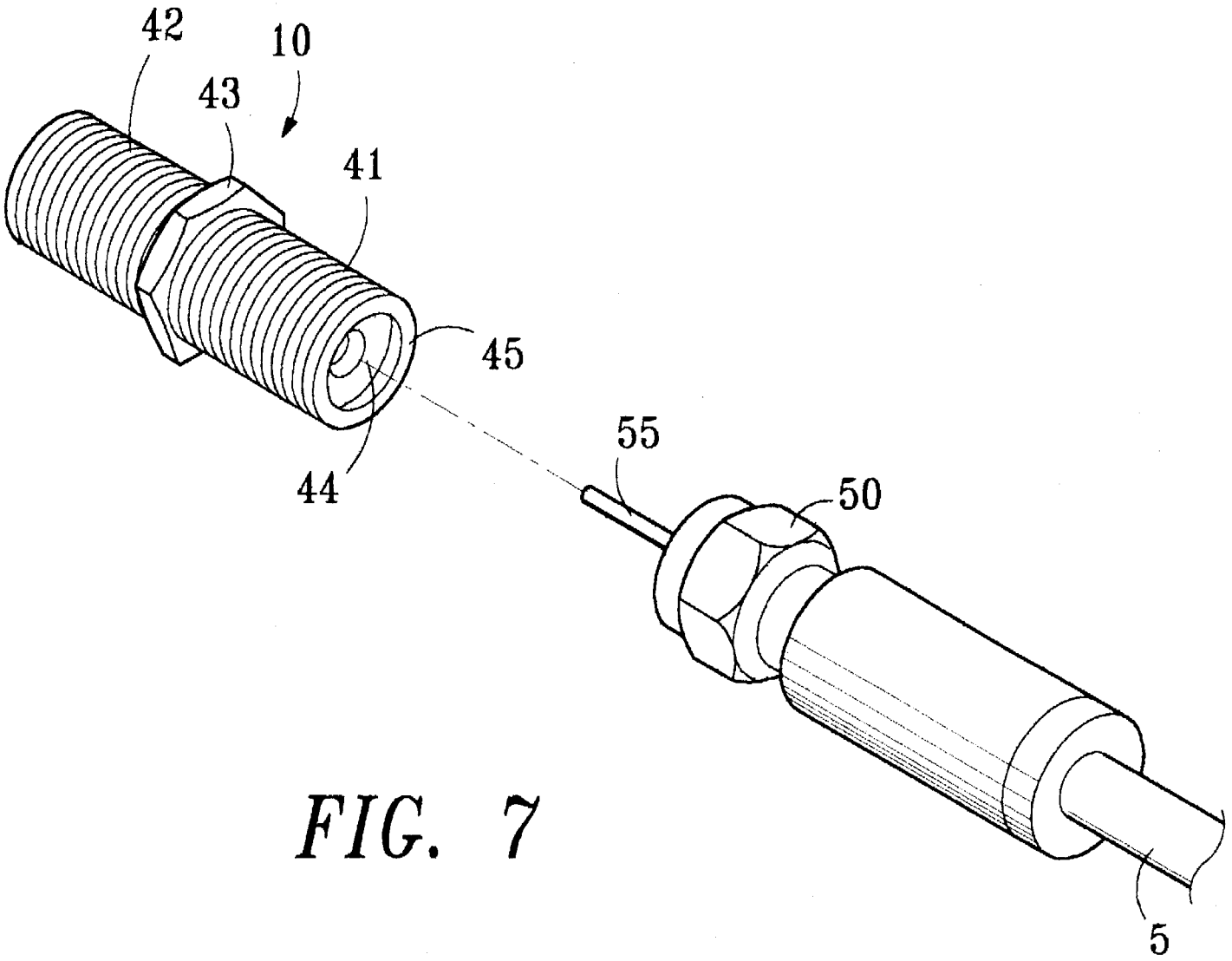
FIG. 7 is a perspective view before joining of the connector of the present invention and a coaxial cable.
Figure 7A:
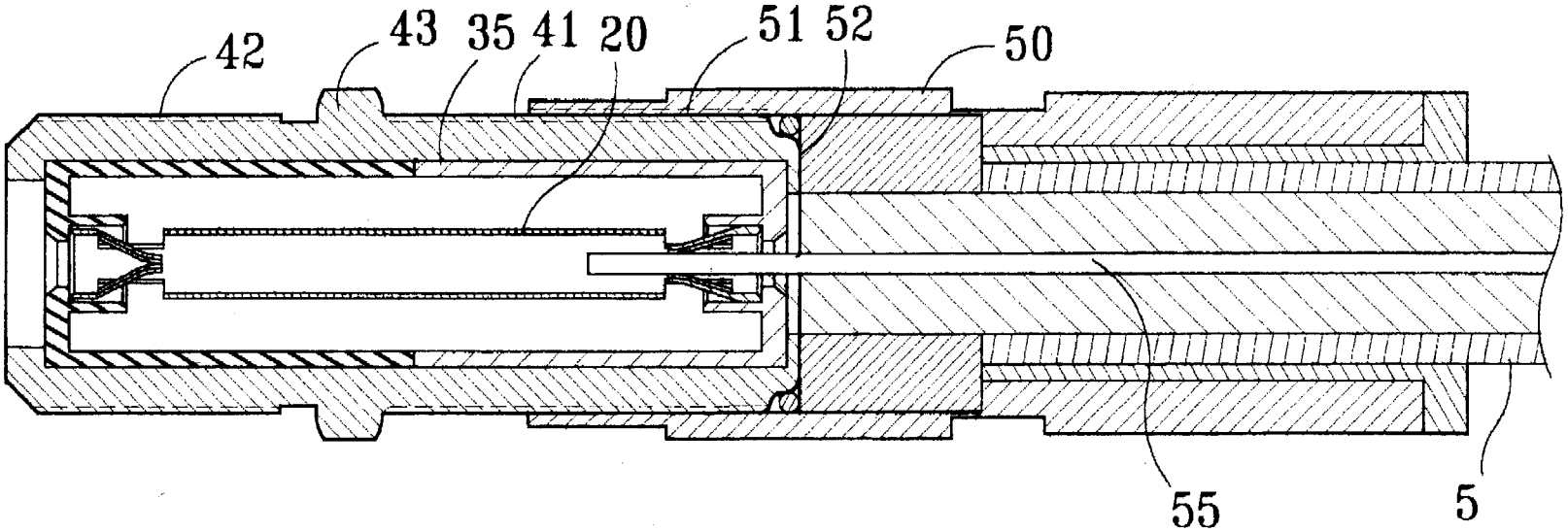

On the top and bottom of the two ends of the contact component 20 two rectangular holes 21 are punched inward with one holes 21 which do not cut end remaining connected to the contact component 20 so as to form a pair of inclined planes 22 and a cambered surfaces 23 extending toward the interior of the tube. As shown in FIG. 7 and FIG. 7A, the central wire 55 of the male connector 50 of the coaxial cable 5 is inserted into hole 32 so as to contact the cambered surface 23 of the contact component 20. The male connector 50 uses inner thread 51 to screw onto the thread 41 of the body 40 of the female connector 10.

Thus, the end surface 45 of the female connector body 40 will join with the inner surface 52 of the male connector 50.

Figure 4A:
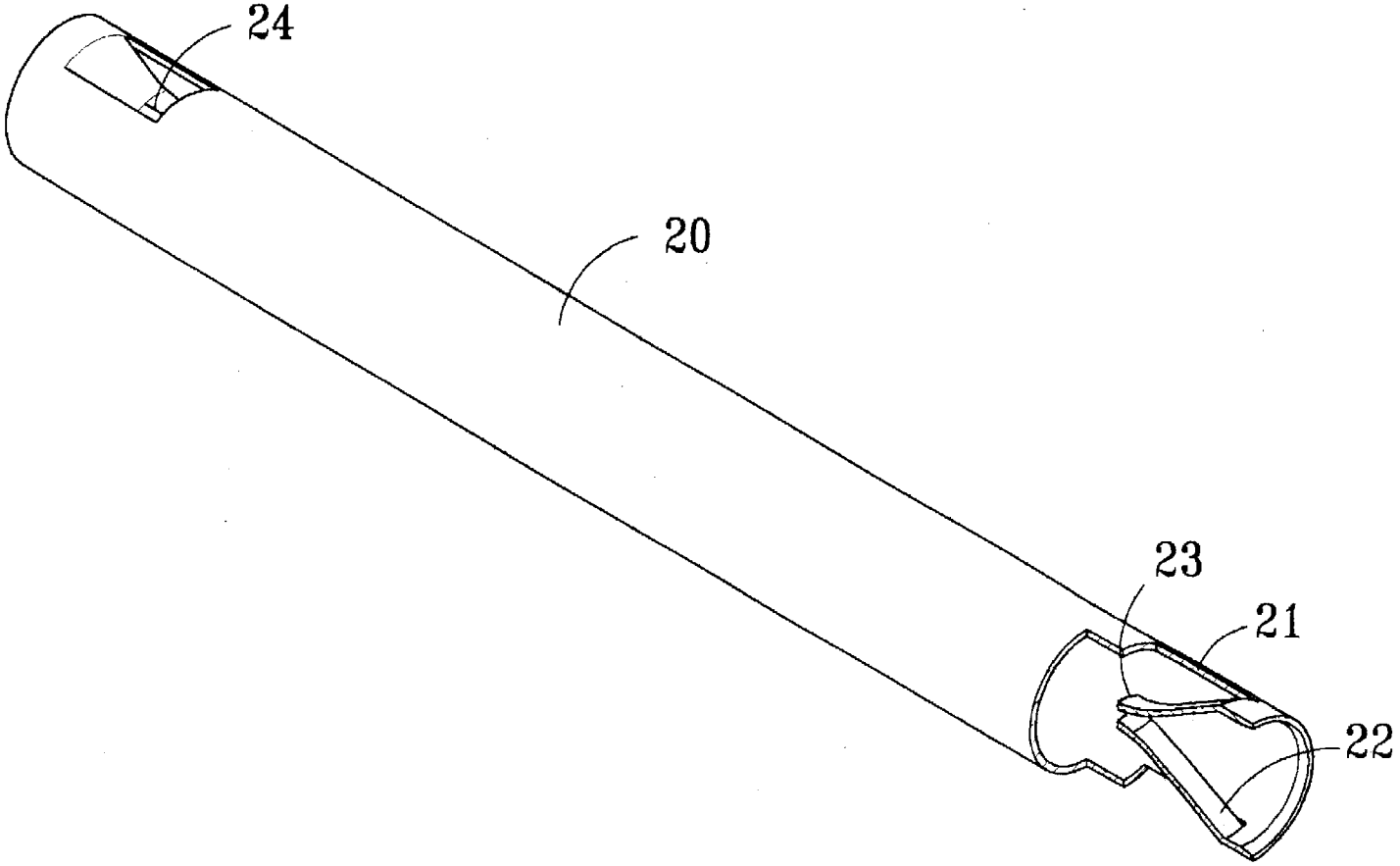
FIG. 4A is a partially broken perspective view of the contact component of the first example of the present invention.
Figure 5:
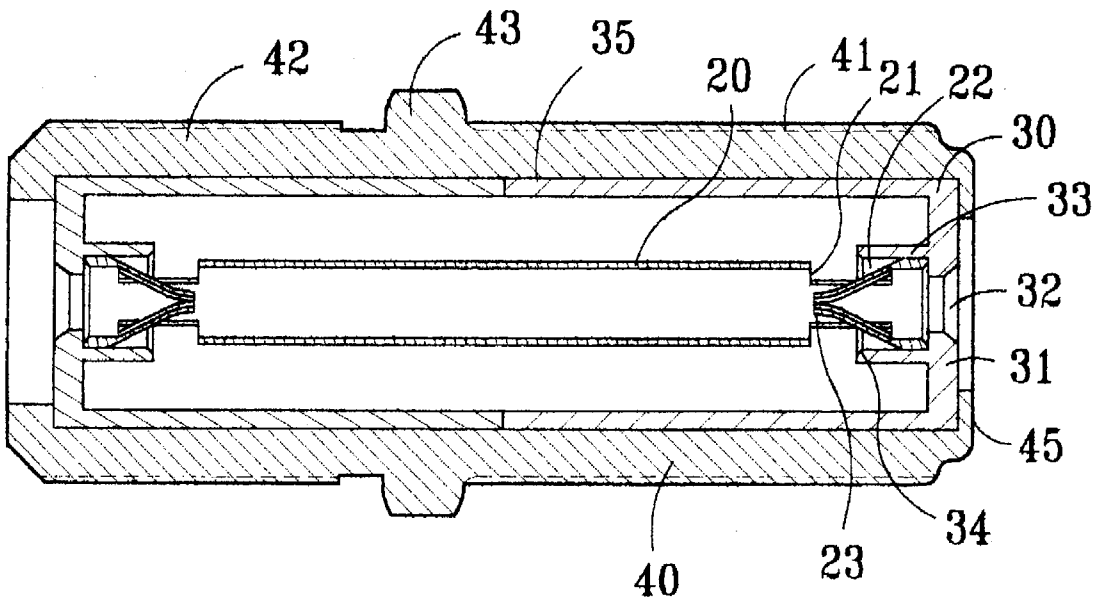
FIG. 5 is a sectional view of the assembled first example of the present invention.

A shown in FIG. 4A, the cambered surface 23 of the contact component is separated by a gap. When the central wire 55 of the coaxial cable is inserted into the connector 20, the two cambered surfaces 23 will open to receive the wire 55.

The insulation component is made from hard plastic material which makes it very easy to insert and to fix the contact component. The materials of the connector are very simple and easy to assemble via automatic mass production. In use, the present invention can reduce power loss greatly and can be used for the various diameters of central wire of the coaxial cable, from 0.5 mm to 1.2 mm (the conventional central wire of coaxial cable is from 0.6 mm to 1.05 mm).

Figure 8:
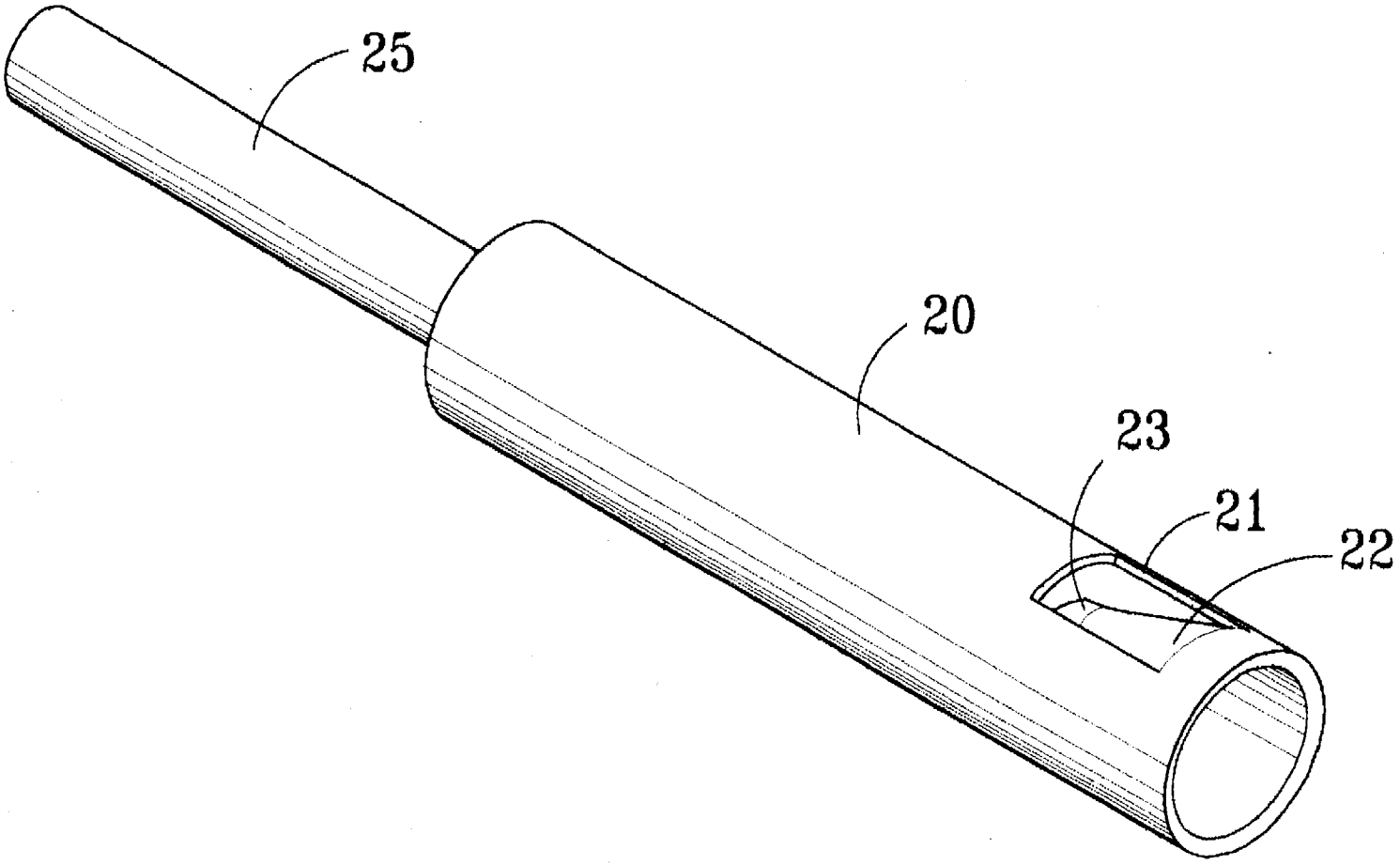
FIG. 8 is a perspective view of the contact component of the second example of the present invention.
Figure 9:
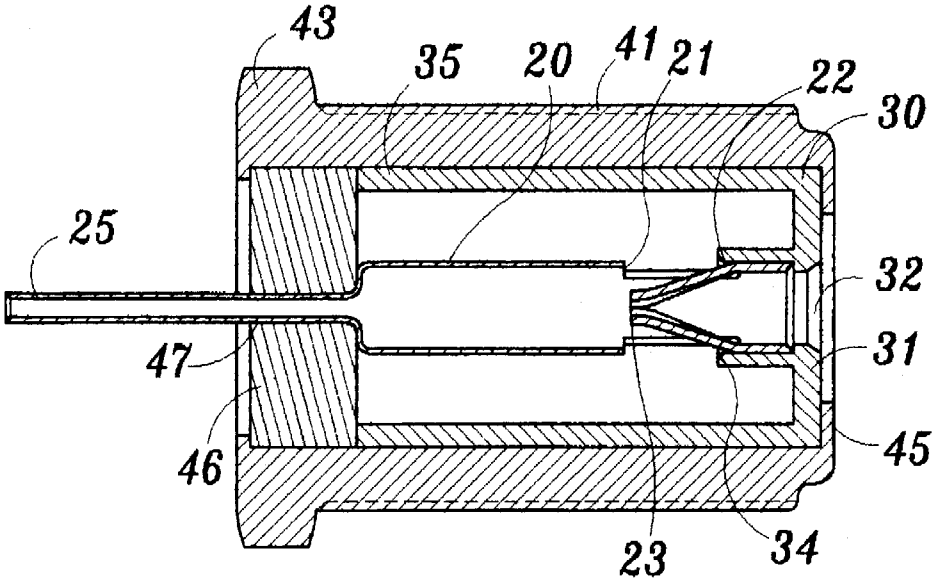
FIG. 9 is a sectional view of the assembled second example of the present invention.

FIG. 8 and FIG. 9 show the second example of the present invention which is a single-end connector. It comprises essentially one side of the above mentioned structure, and also modifies the structure of the contact component 20 slightly. One end of the component 20 includes a pin 25 that passes through the central hole 47 (see FIG. 9) of the closed end 46 of the connector. As the present invention has characteristics of low impedance, low power loss (good match of 75), and high current flow, it will largely improve the electrical characteristic of electrical circuits.

Figure 11:
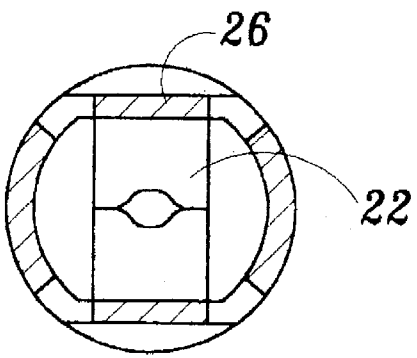
FIG. 11 is a sectional view along line 11 of FIG. 10 of the present invention.
Figure 10:
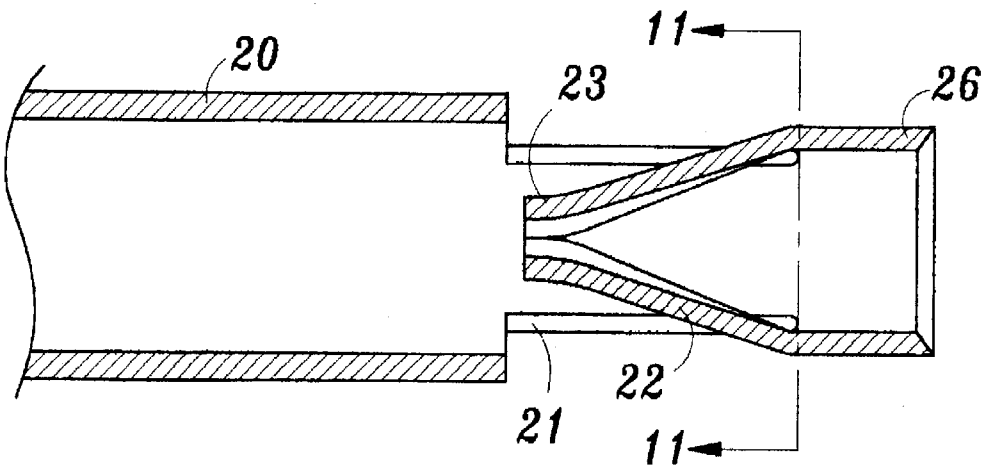
FIG. 10 is a sectional view of the joining component of the third example of the present invention.

FIG. 10 and FIG. 11 sow the third example of the present invention which is another structure of the contact component 20. The two ends of the contact component 20 can be a flat-head shape 26, or the ends can be arced.

Figure 12:
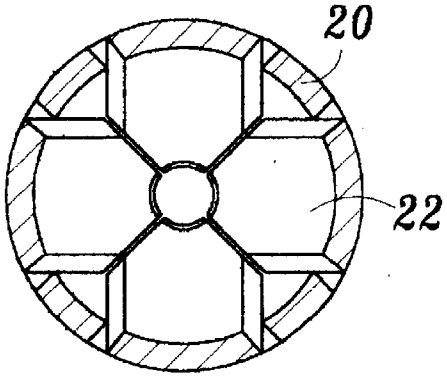
FIG. 12 is a sectional view of the joining component of the fourth example of the present invention.

As shown in FIG. 12, the fourth example of the present invention is another structure of the contact component 20 that includes open holes 21 near the four sides (top, bottom, right and left) of the two ends of the contact component 20. In this embodiment, the holes 21 each form an inclined plane 22 and a cambered surface 23.

According to the above examples, the connector for a coaxial cable of the present invention comprises three components with very simple structure that can be easily assembled. The present invention can use automatic assembly to reduce the failure rate.

Figure 4C:
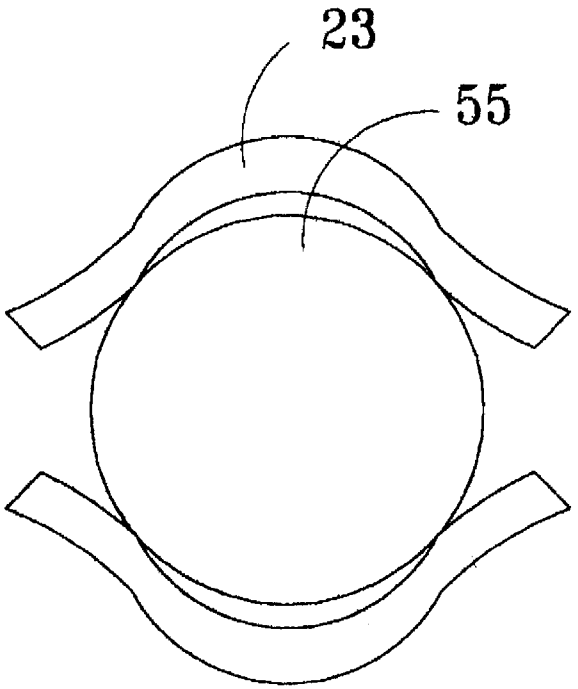
FIG. 4C is a cross section view of the first example of the present invention when the contact component joins with a thick central wire.
Figure 4B:
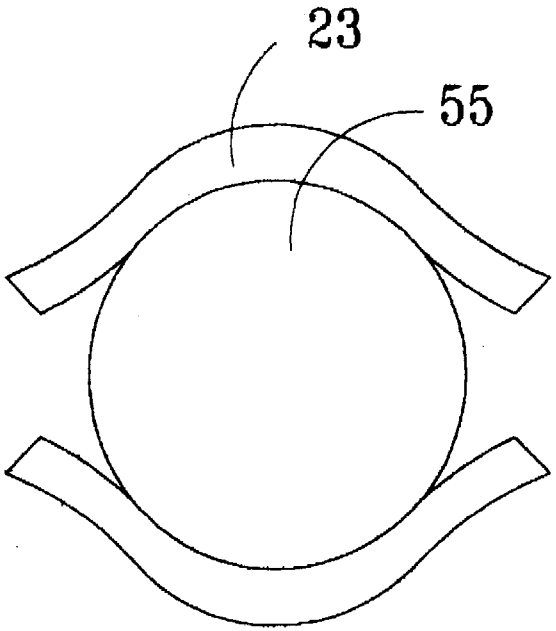
FIG. 4B is a cross section view of the first example of the present invention when the contact component join with the thin central wire.
Figure 6:
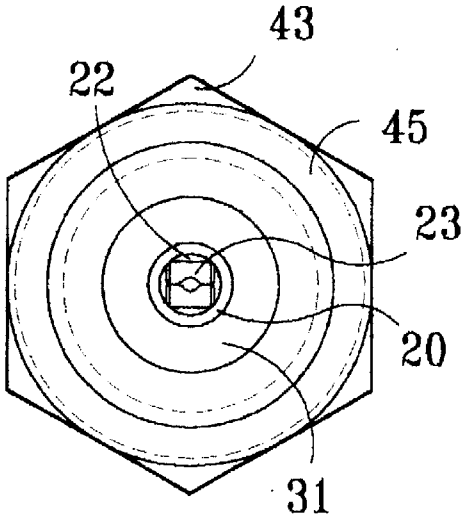
FIG. 6 is right side view of the FIG. 5 of the present invention.

With the fourth embodiment, the operating characteristic of appliances can be improved because there is no longer point contact, but rather a line contact (thick central wire, FIG. 4C) or a surface contact (thin central wire, FIG. 4B). The line contact at least has four lines for contact which provides a better connection structure than conventional connectors. The line contact has less power and can be used for a larger range of central wire diameter (0.5 mm to 1.2 mm) which allows larger current flow is safer for use, is low cost, and is a very practical product.

Many changes and modifications in the above described embodiment of the invention can, of course, be carried out without departing from the scope thereof. Accordingly, to promote progress in science and the useful arts, the invention is disclosed and is intended to be limited only by the scope of the appended claims.

What is claimed is:

1. A connector for a coaxial cable comprising:

a connector body with a channel therein, a pair of cylindrical insulation components that cover an interior of said connector body, each said insulation component includes a socket in an outer end thereof, a tubular contact component with a plurality of holes punched inward such that one end of material punched inward remains connected to said contact component, thereby forming an inclined plane and a cambered surface; such that pairs of said inclined planes and said cambered surfaces form at least one partially closed opening to receive a central wire of the coaxial cable, said opening is circular in shape and provides a planar contact surface for said central wire.

2. The connector as claimed in claim 1 wherein:

ends of said contact component are circular.

3. The connector as claimed in claim 1 wherein:

ends of said contact component are flat on two opposing sides.

4. The connector as claimed in claim 1 wherein:

one end of said connector body includes a pin.

* * * * *